US005636392A

United States Patent [19]

Choi

[11] Patent Number: 5,636,392

[45] Date of Patent: Jun. 10, 1997

[54] HAMMOCK

[76] Inventor: Yong S. Choi, 11/5, 416-5 2 ga, Samsun-dong, Sungbuk-ku, Seoul, Rep. of Korea

[21] Appl. No.: 200,499

[22] Filed: Feb. 23, 1994

[30] Foreign Application Priority Data

Feb. 24, 1993 [KR] Rep. of Korea ..... 93UM2607
Jun. 21, 1993 [KR] Rep. of Korea ..... 93UM10993

[51] Int. Cl.[6] ..... A45F 3/24

[52] U.S. Cl. ..... 5/127; 5/120

[58] Field of Search ..... 5/120, 122, 129, 5/127; 403/377, 109

[56] References Cited

U.S. PATENT DOCUMENTS

| | | | |
|---|---|---|---|
| 198,942 | 1/1878 | Holmes | 5/127 |
| 893,083 | 7/1908 | Locke | 5/129 |
| 950,070 | 2/1910 | Funke | 5/129 |
| 2,745,115 | 5/1956 | Reiss | 5/122 |
| 3,593,352 | 7/1971 | Britt | 5/129 |
| 4,662,132 | 5/1987 | Tennant | 5/127 |
| 4,951,332 | 8/1990 | Barmettler | 5/120 |
| 5,003,652 | 4/1991 | Bayless | 5/129 |

FOREIGN PATENT DOCUMENTS

| | | | |
|---|---|---|---|
| 51568 | 4/1936 | Denmark | 5/129 |
| 2307492 | 11/1976 | France | 5/120 |
| 2702593 | 7/1978 | Germany | 5/127 |
| 434568 | 4/1948 | Italy | 5/127 |
| 585299 | 11/1958 | Italy | 5/127 |
| 697011 | 10/1965 | Italy | 5/120 |
| 90-8588 | 9/1990 | Japan . | |

*Primary Examiner*—Michael J. Milano
*Attorney, Agent, or Firm*—Burns, Doane, Swecker & Mathis, LLP

[57] ABSTRACT

A hammock includes a netting for receiving a user, the netting having cords at opposite ends thereof. The hammock further includes a base member, the base member including left and right pipe assembly lines and front and rear connecting members for connecting the pipe assembly lines. The connecting members have anchors for anchoring the cords of the netting thereto. The left and right pipe assembly lines of the base member are foldable lengthwise.

18 Claims, 8 Drawing Sheets

HAMMOCK

BACKGROUND OF THE INVENTION

This invention relates to hammocks and particularly to hammocks comprising nettings and swingable bases.

When a conventional hammock having no supports is to be installed in an open area, or the like, it is usually swung from cords at both ends between two trees. In installing this kind of hammock, a lot of time and efforts is required for adjusting for distance between trees, height of a netting, and load resistant capacity.

When other conventional hammocks having supports, i.e., tripod supports are to be installed indoors, or the like, brackets are used for supporting the tripod supports. The tripod supports are complicated to install, heavy and bulky, thus extremely difficult to keep and carry.

In addition, users are likely to get bored with the conventional hammocks because they sway only sidewards with respect to a user's body.

SUMMARY OF THE INVENTION

An object of the present invention is to provide a hammock having a non-folding swingable base attached thereto, which swings lengthwise and widthwise, thus comforting and amusing a user.

Another object of the present invention is to provide a hammock having a sectional base member which are easy to assemble and disassemble Still another object of the present invention is to provide a hammock having a telescopic base member which is readily collapsible when not in use and which folds into a comparatively small package for storage and shipment.

Another object of the present invention is to provide a hammock which is easy to install, light in weight and simple in construction.

A hammock according to an embodiment of the present invention includes a netting of strong toughness having opposite cords for being slung, the netting being adapted to receive a user, a base member including pipe assembly lines and connecting members for connecting the pipe assembly lines, the connecting members having anchor means for anchoring the cords of the netting thereto, and means for folding the base member lengthwise.

BRIEF DESCRIPTION OF THE DRAWINGS

The invention is explained in detail by means of constructional examples with reference to the drawings.

In the drawings.

DETAILED DESCRIPTION OF THE INVENTION

Figure 1:
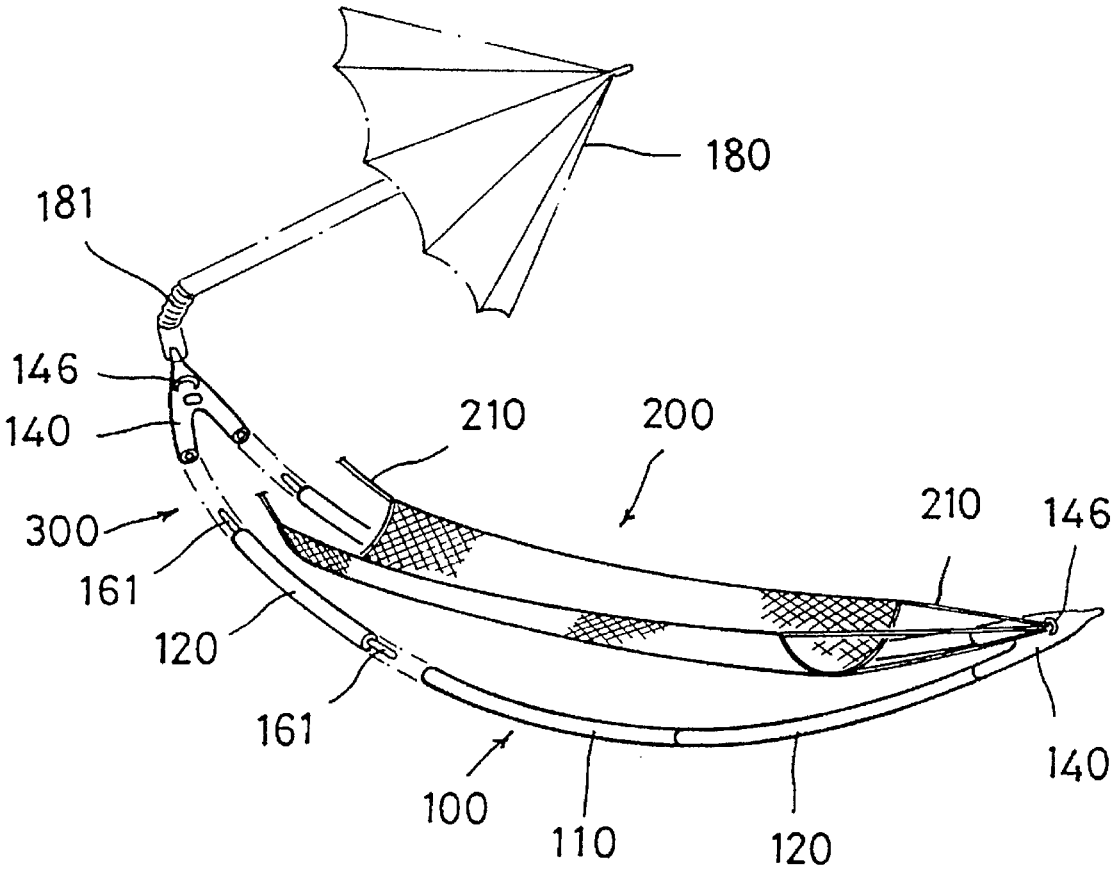
FIG. 1 is a perspective view of a hammock of the present invention, showing two arc-shaped pipe assembly lines which are connected by V-shaped connecting pipes, the two pipe assembly lines constituting a base member.

Referring to the drawings, and particularly to FIG. 1, a base member 100 comprises upwardly facing arc-shaped front and rear sectional pipe lines which are connected by V-shaped connecting pipes 140. Each pipe line comprises a middle pipe 100 and side pipes 120. Each side pipe 120 has studs 161 at opposite ends thereof which constitutes an assembly means 300 for press fitting into matching axial bores in the middle pipe 110 and the V-shaped connecting means 140, respectively, when assembled.

Each V-shaped connecting pipe 140 has anchor means 146 fixed thereto for anchoring cords 210 thereto. A netting 200 is slung by the cords 200. The netting 210 of preferably large meshes is made of synthetic resin or nylon having toughness and sized to snugly receive a user's body.

The pipe assembly base 100 is upwardly facing arc-shaped and at least one point thereof is adjusted to contact with the floor or ground. When viewed from sides, at least two points are adjusted to contact with the floor or ground for accomplishing safe swinging movement of the hammock.

With this arrangement, the engagement and disengagement of the pipes 110, 120 are accomplished only by a slight intentional force. The sectional base member 100 of this embodiment is easy to keep.

Figure 2:
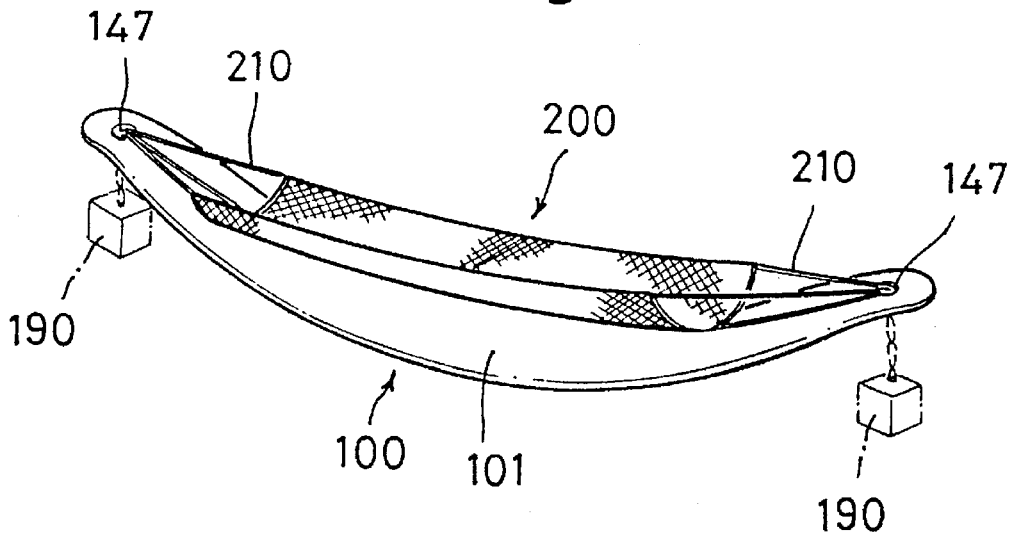
FIG. 2 is similar to FIG. 1, but showing a plate or board base member.

In FIG. 2, instead of the pipes 110, 120 a non-folding integral plate or board 101 is used as the base member 100. Cords 210 are anchored at both ends by anchor means 147. The integral plate or board 101 is comparatively easy to manufacture and it has a bottom face contacting with the floor or ground larger than the sectional pipe base member 100 in FIG. 1. In detail, the largest width of the plate or board 101 contacts with the floor or ground so that swinging movement is achieved more safely than by the pipes 110 and 120 in FIG. 1. As the plate or board 101, a wistaria or compression wood having elasticity and strength, or synthetic resin of high strength are preferably used. In addition, aluminium having anti-corrosion, elastic, strength properties is preferably used.

Figure 3:
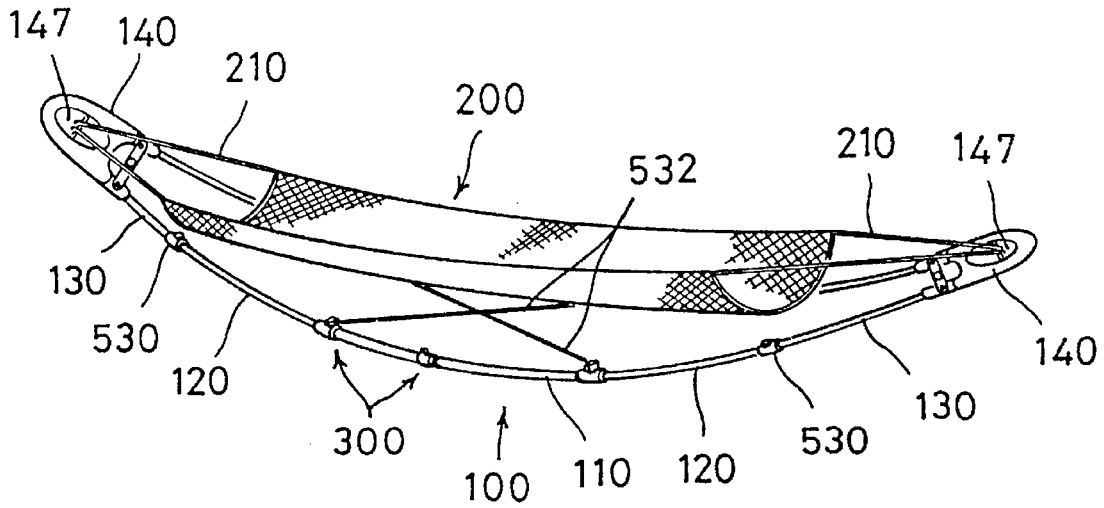
FIG. 3 is similar to FIG. 1, but showing telescopic pipe assembly lines.
Figure 4:
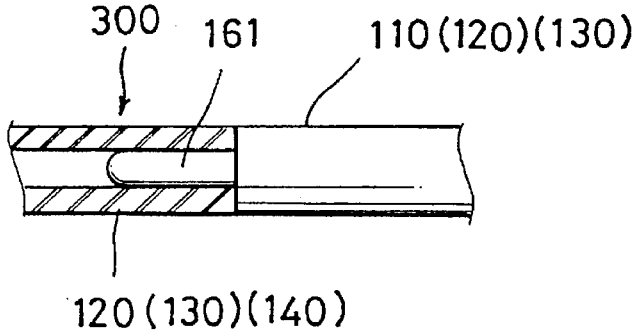
FIG. 4 is a cross-section showing the fastening of a middle pipe and a side pipe which is accomplished by press fitting a cylindrical protrusion of the side pipe into matching axial opening of the middle pipe.
Figure 9:
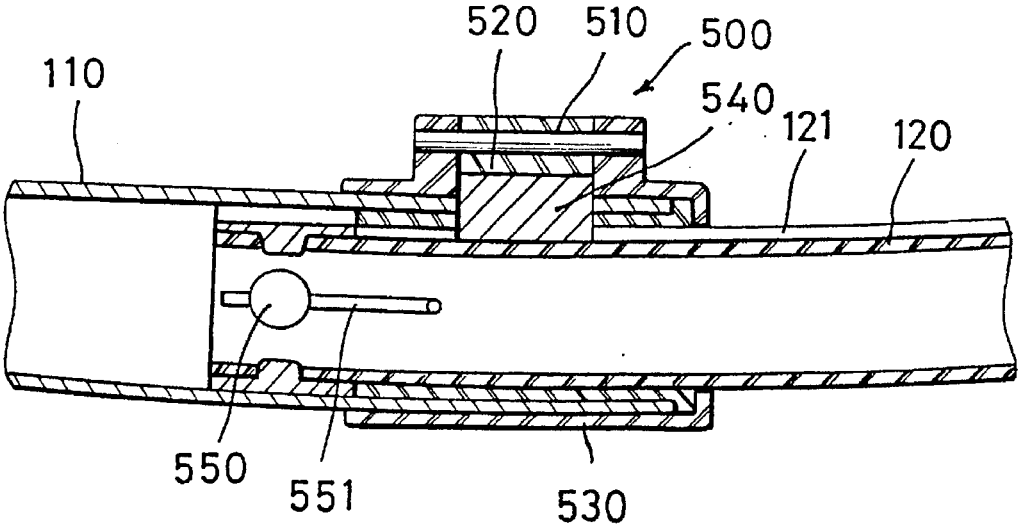
FIG. 9 is a longitudinal sectional view showing two pipes held in place by pivotal lock lever.

FIG. 3 shows telescopic pipes 110, 120 and 130 constituting the base member 100. To positively prevent any inadvertent collapsing or moving of the structure, there is provided locking brace means 500 (FIGS. 5–6 and 9–12) in the form of a pivotable lock lever 510 which has an integral eccentric cam 511 at the lower end thereof. The cam 511 is hinged to opposite side ribs 521 by a pivot pin 520. As shown in FIG. 9, a friction pad 540 is provided at the contact face of the eccentric cam 511 and the side pipes 120, 130, thus preventing any possible scratching or marring of the contact face. The middle pipe 110 has a diameter larger than side pipes 120, 130 and is of arc-shape and the side pipes 110 have diameter corresponding to the inner diameter of the middle pipe 110. Other elements in the embodiment in FIG. 3 function the same as in the embodiment in FIG. 1.

Figure 10:
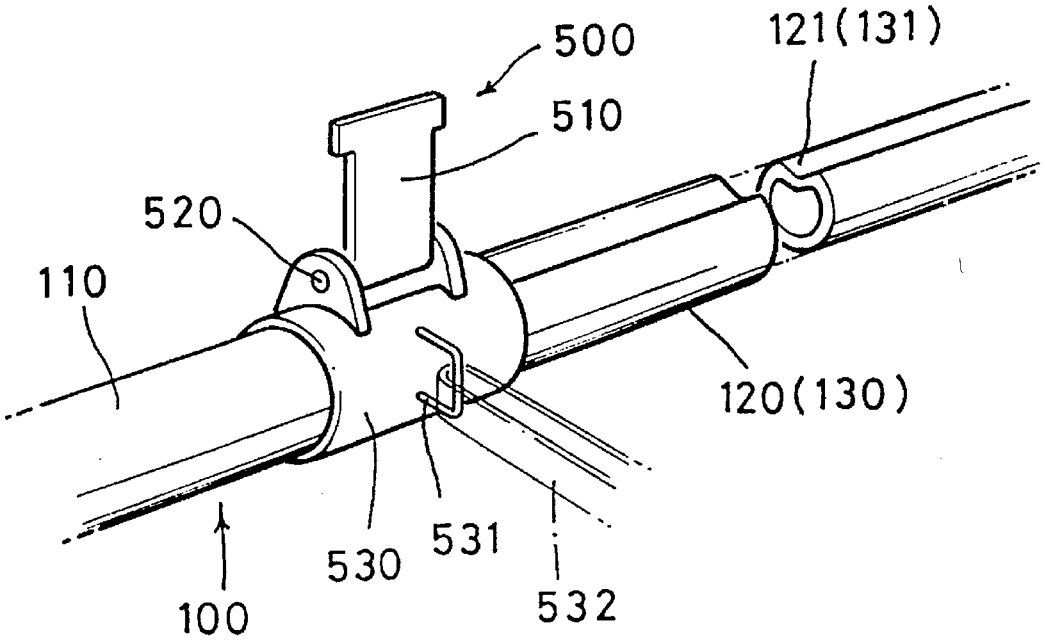
FIG. 10 is an exploded perspective view of FIG. 5, showing bead groove formed axially on the periphery of side pipes.
Figure 11:
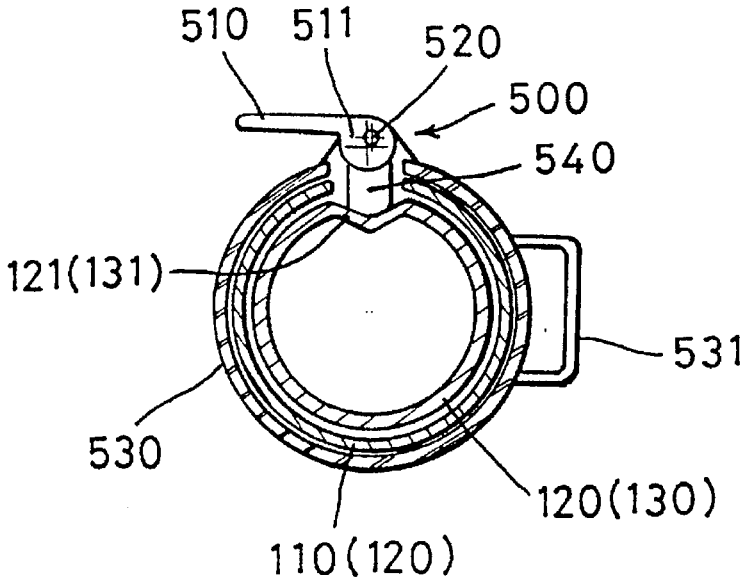
FIG. 11 is a longitudinal sectional view of FIG. 5.

As shown in FIG. 10, alternatively, the telescopic side pipes 120 and 130 may have axially extending bead grooves 121 and 131 on the periphery thereof for reinforcement and twisting-prevention purpose.

Figure 5:
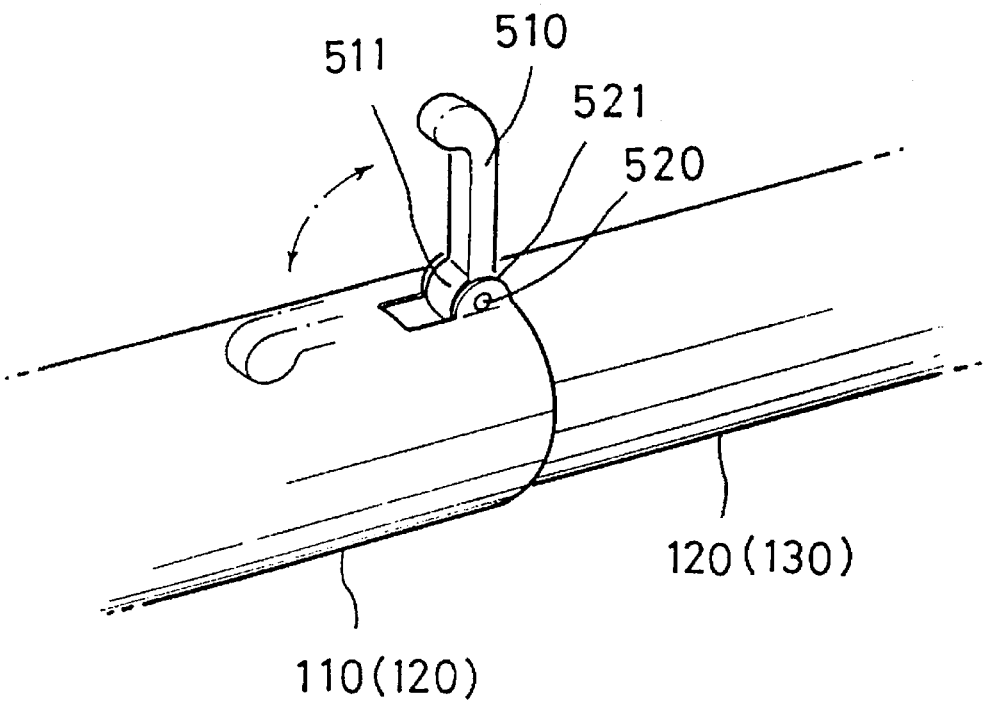
FIG. 5 shows a pivotal lock lever holding two pipes in place.
Figure 6:
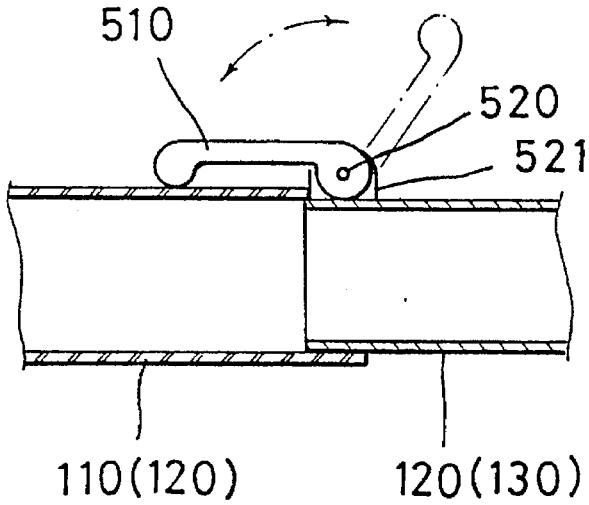
FIG. 6 is a longitudinal sectional view of FIG. 5.

In FIGS. 5 and 6, the pivotal movement of the lock lever 510 is shown in full outline and in dashed outline. When in use, the outer face of the eccentric cam 511 presses the side pipes 120 and 130 as shown in full outline in FIG. 5. When being telescoped, the lock lever 510 is pivoted and assumes the position shown in solid line in FIG. 6.

Another locking brace means 500 shown in FIG. 10 may be used in the hammock of the embodiment in FIG. 3. In the Figure, the lock lever 510 is hinged to an outer support pipe 530 by the pivot pin 520.

Figure 12:
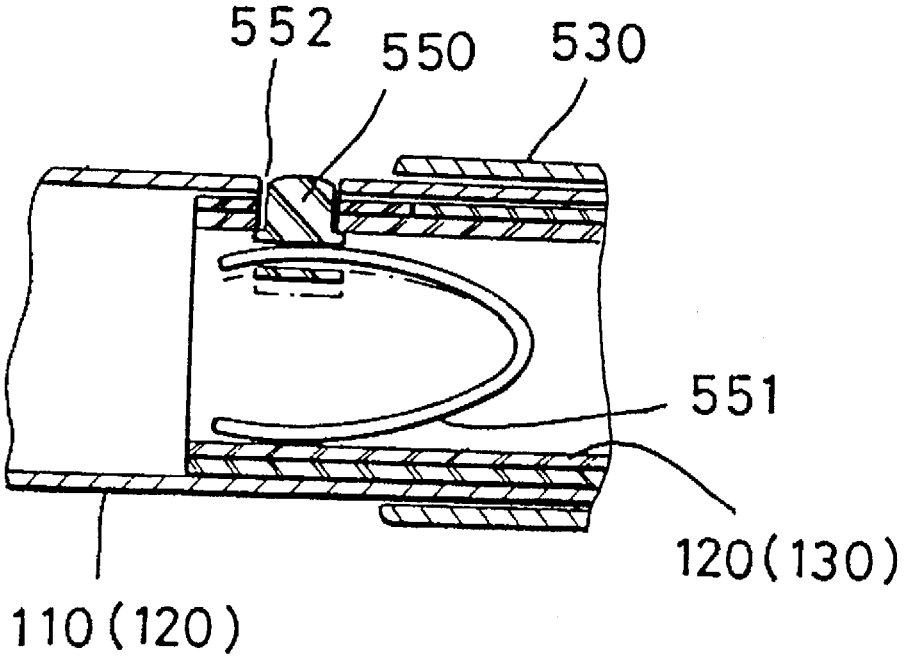
FIG. 12 is a longitudinal sectional view of a lock button locking means.

As shown in FIG. 12, the pipes 110, 120 and 130 may have bores 552 on the peripheries thereof which receive a button 550 when the pipe base 100 is unfolded. This button structure is arranged together with the lock lever 510 structure. With this arrangements, the telescopic pipe base 100 is not inadvertently collapsed.

Figure 8A:
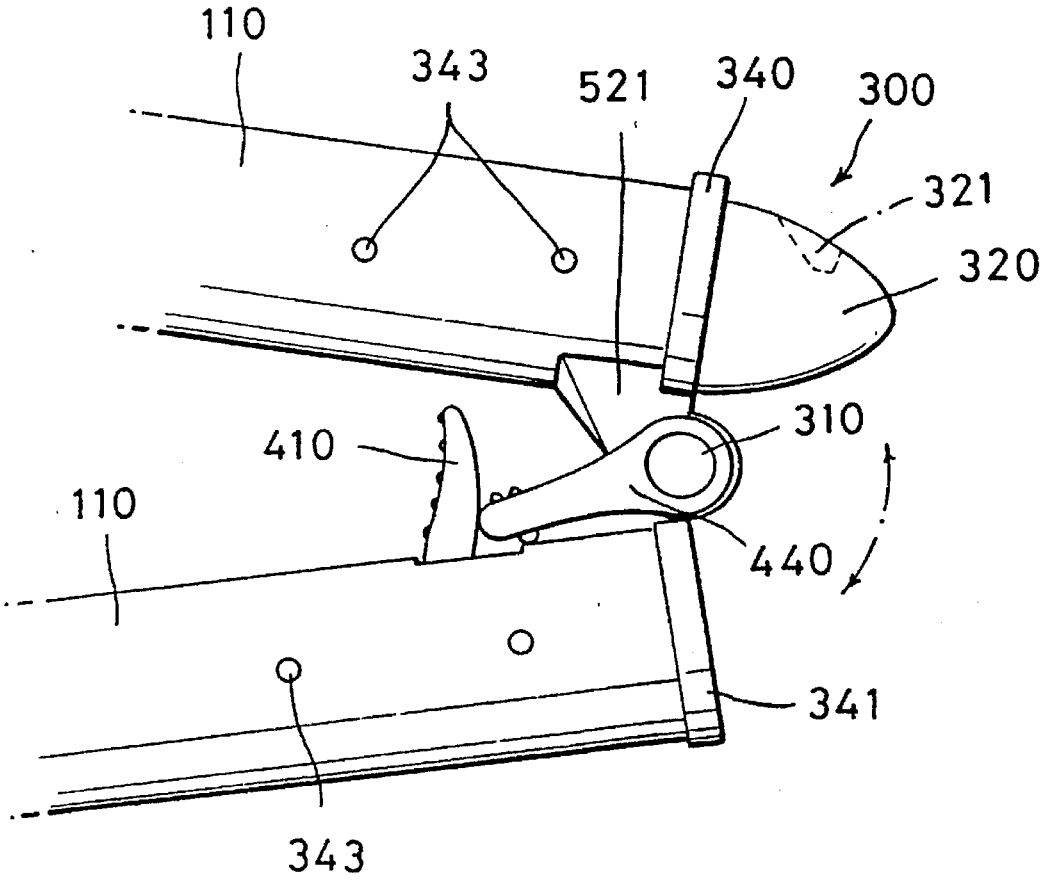
FIG. 8A shows the middle pipe having two sections which are hingedly connected to each other by a pivot pin.
Figure 8B:
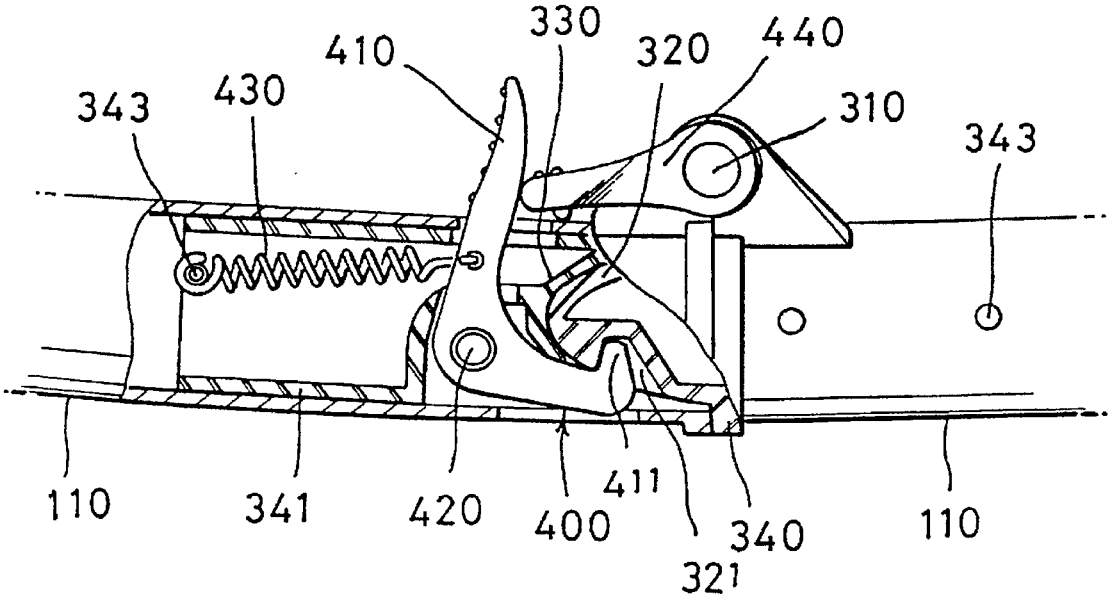
FIG. 8B is a longitudinal sectional view of FIG. 8A.

FIGS. 8A and 8B show the middle pipe 110 having two halves hinged by a pivot pin 310, which constitute forms part of the assembly means 300. One half of the pipe 110 has an integral hemispherical protrusion 320 having a latch recess 321. Reinforcing pipes 340 and 341 are mounted within the two halves and retained in the two halves by means of pins 343, with one reinforcing pipe having a matching recess 330 for receiving the hemispherical protrusion 320. With the hemispherical protrusion 320, the two halves are folded smoothly.

A pivotable step element 440 is hingedly attached to the integral rib 521 by the pivot pin 310 for preventing any inadvertent rotation of a latch member 400, thus for preventing any inadvertent collapsing or moving of the folding pipe 110. The latch member 400 comprising an upper end 410 and a tip 411 is hingedly attached to the reinforcing pipe 341 by a pivot pin 420. The tip 411 is biased in the latching position by a coil spring 430. When it is desired to fold the middle pipe 110, the lever member 400 is manually operated to disengage the tip 411 from the latch recess 321.

With this arrangement, with the stop element 440 in the positon in FIG. 8B, the rotation of the lever member 400 is prevented.

Figure 7:
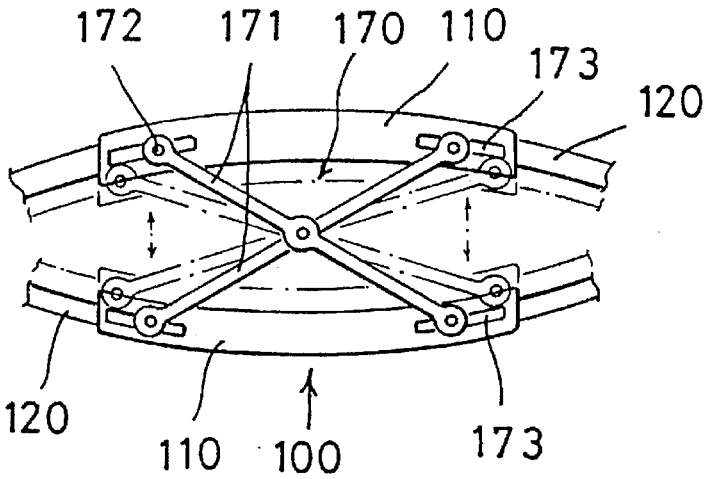
FIG. 7 is a plan view of a cross-shaped folding means for folding pipe assembly lines with respect to each other.

FIG. 7 shows width folding means 170 for folding the front and rear pipe lines. A pair of links 171 are hingedly attached to the pipes 110 by pivot pins 172. At the opposite ends of the pipes 110 are provided slits for slidingly guiding the pins 172. With this arrangements, the links 171 perform scissors-like operation, thus adjusting the width of the front and rear pipe lines. The links 171 are provided to positively prevent any inadvertent unfolding of the base member 100. To prevent any inadvertent collapsing or moving of the base member 100, the latch member 400 is provided.

Figure 13:
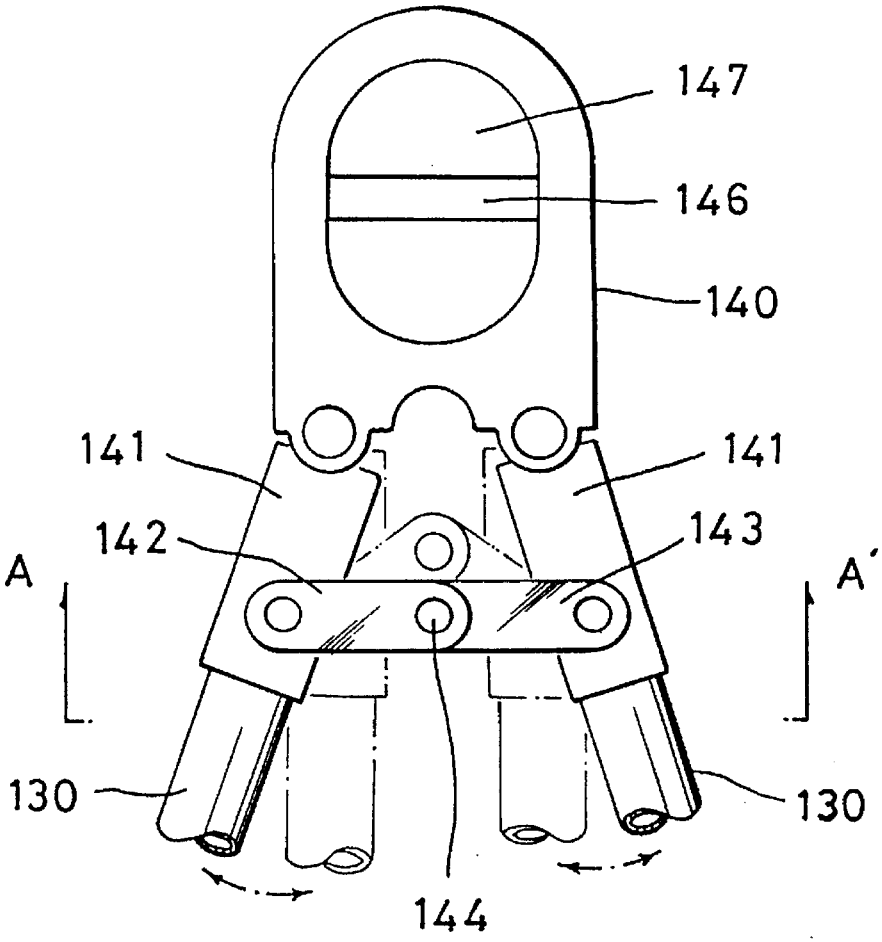
FIG. 13 shows a linkage for folding pipe assembly lines with respect to each other.
Figure 14:
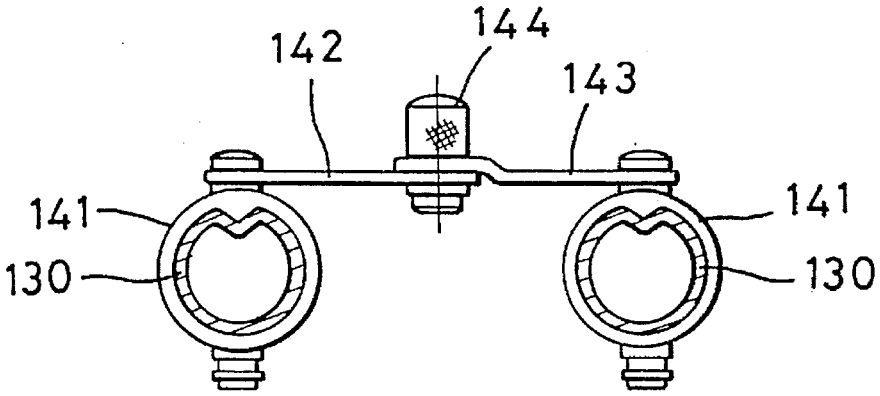
FIG. 14 is a sectional view taken along lines A—A' of FIG. 13.

Instead of the V-shaped connecting pipes 140, another connecting member 140 may be used as shown FIGS. 13 and 14. The connecting member 140 is hingedly attached to pivotal leg members 141. Two pivotal brace sections 142, 143 interconnect the pivotal leg members 141 and hingedly and frictionally retained in aligned relation in a conventional manner as at 144 for retaining the base member 100 in unfolded position. By turning the brace sections 142 and 143 around the hinge and frictional lock connection 144 and turning the sections 142 and 143 in relation to each other, the distance between the leg members 141 is decreased, thus making the folding base member 100 folded.

As shown in FIG. 10, the outer support pipe 530 has anchor means 531 to which are attached cords or bands 532, thus preventing over widening of the front and rear pipe lines from each other.

As shown in FIG. 2, for anchoring the cords 210 to the base member 100, bores 147 are provided in the opposite top ends of the base member 100. The cords 210 pass through the bores 147. In addition, as shown in FIG. 13, a large opening 147 and a cross loop 146 are provided. The cords 210 are fixed to the loop 146. Of course, other cord fixing means may be used.

With the hammock having the above structures, when a user lies in and sways the hammock, the hammock will swing sidewards, and back and forth by inertia force and reaction of loads.

For increasing inertia force at the opposite ends of the base member 100, weight member 190 is provided. With this arrangement, the lengthwise swinging movement is maintained continuously, thus giving the user no tedious feeling.

As shown in FIG. 1, a parasol 180 may be mounted on one top end of the base member 100 for blocking off strong sunshine. For providing angle-adjustable parasol 180, a flexible tube 181 is preferably used to connect the parasol 180 and its mounting portion of the base member 100. While this invention has been illustrated and described in accordance with a preferred embodiment, it is recognized that variations and changes may be made therein without departing from the invention as set forth in the claims.

What is claimed is:

1. A hammock comprising:

a netting for receiving a user, the netting having cord means at opposite ends thereof;

a base member, the base member including arcuate left and right pipe assembly lines and detachable front and rear V-Shaped connecting members for connecting the pipe assembly lines, the connecting members having anchor means for anchoring the cord means of the netting thereto;

lengthwise folding means for folding the left and right pipe assembly lines of the base member lengthwise; and the left and right pipe assembly lines permitting a lengthwise rocking motion of the hammock.

2. A hammock according to claim 1, further comprising widthwise folding means for folding the left and right pipe assembly lines of the base member widthwise, the widthwise folding means including a pair of links hingedly attached to each other at middle portions thereof by pivot means, opposite ends of each link being hingedly connected to the left and right pipe assembly lines, each of the left and right pipe assembly lines having elongated slots for slidably receiving portions of the links such that a crossing angle of the links is adjustable.

3. A hammock according to claim 1, wherein each of the left and right pipe assembly lines is formed by two or more pieces, the folding means including, for each of the left and right pipe assembly lines, a protrusion associated with a first one of the pieces and a mating recess associated with a second one of the pieces for receiving the protrusion when the first and second pieces are in an unfolded condition.

4. A hammock according to claim 1, wherein each of the left and right pipe assembly lines is formed by two or more pieces, the hammock further comprising, for each of the left and right pipe assembly lines, a pivotal lock lever, the pivotal lock lever having an integral eccentric cam hingedly attached to a first end of a first one of the pieces, a first end of a second one of the pieces being telescopingly received in the first end of the first one of the pieces, the pivotal lock lever being pivotal between an open and a closed position such that the eccentric cam causes the first ends of the first and second pieces to be unlocked and locked relative to each other, respectively.

5. A hammock according to claim 1, wherein the anchor means includes loop members for fixedly anchoring the cord means thereto.

6. A hammock according to claim 1, wherein the anchor means includes bores for fixedly receiving the cord means therein.

7. A hammock according to claim 1, wherein the connecting members each include a pair of pivotal leg members, the leg members being interconnected to each other by a two-piece pivotal lock braceover.

8. A hammock according to claim 1, wherein axial bead grooves are formed on at least portions of the left and right pipe assembly lines.

9. A hammock according to claim 3, wherein the folding means further includes latch means for engaging the protrusion when the first and second pieces are in the unfolded condition.

10. A hammock according to claim 4, wherein, for each of the left and right pipe assembly lines, a button is resiliently mounted at and is at least partially biased outwardly from the first end of the second one of the pieces by a panel spring, the first end of the first one of the pieces being provided with a bore for receiving the button when the first end of the second one of the pieces is telescopingly received in the first end of the first one of the pieces.

11. A hammock according to claim 4, wherein a friction pad is provided between the eccentric cam and the first end of the second pipe for preventing scratching or marring of the eccentric cam.

12. A hammock according to claim 7, further comprising one or more loops associated with each of the left and fight pipe assembly lines, and one or more bands anchored to the one or more loops, the bands maintaining a maximum distance between the left and fight pipe assembly lines.

13. A hammock according to claim 10, further comprising a pivotable stop element for preventing rotation of the pivotal lock lever.

14. A hammock according to claim 2, wherein the connecting members each includes a pair of pivotal leg members, the leg members being interconnected to each other by a two-piece pivotal lock braceover.

15. A hammock according to claim 2, wherein axial bead grooves are formed on at least portions of the left and right pipe assembly lines.

16. A hammock according to claim 3, wherein axial bead grooves are formed on at least portions of the left and right pipe assembly lines.

17. A hammock comprising:

a netting for receiving a user, the netting having cord means at opposite ends thereof;

a base member, the base member including left and right pipe assembly lines and front and rear connecting members for connecting the pipe assembly lines, the connecting members having anchor means for anchoring the cord means of the netting thereto; and means for folding the left and right pipe assembly lines of the base member lengthwise, each of the left and fight pipe assembly lines being formed by two or more pieces, the folding means including, for each of the left and right pipe assembly lines, a protrusion associated with a first one of the pieces and a mating recess associated with a second one of the pieces for receiving the protrusion when the first and second pieces are in an unfolded condition, the folding means further including latch means for engaging the protrusion when the first and second pieces are in the unfolded condition, the latch means including a hook-shaped tip for being received in a matching recess in the protrusion of the one-piece middle pipe and a coil spring for biasing the tip in a latching position.

18. A hammock comprising:

a netting for receiving a user, the netting having cord means at opposite ends thereof;

a base member, the base member including left and right pipe assembly lines and front and rear connecting members for connecting the pipe assembly lines, the connecting members having anchor means for anchoring the cord means of the netting thereto; and means for folding the left and right pipe assembly lines of the base member lengthwise, each of the left and right pipe assembly lines being formed by two or more pieces, the folding means including, for each of the left and right pipe assembly lines, a protrusion associated with a first one of the pieces and a mating recess associated with a second one of the pieces for receiving the protrusion when the first and second pieces are in an unfolded condition, wherein the connecting members each includes a pair of pivotal leg members, the leg members being interconnected to each other by a two-piece pivotal lock braceover.

* * * * *